US011506229B2

(12) United States Patent
Cannata

(10) Patent No.: US 11,506,229 B2
(45) Date of Patent: Nov. 22, 2022

(54) MODULAR HYDRAULIC DEVICE

(71) Applicant: TONAND INC., London (CA)

(72) Inventor: Antonio Cannata, London (CA)

( * ) Notice: Subject to any disclaimer, the term of this patent is extended or adjusted under 35 U.S.C. 154(b) by 0 days.

(21) Appl. No.: 17/241,521

(22) Filed: Apr. 27, 2021

(65) Prior Publication Data

US 2021/0246917 A1 Aug. 12, 2021

Related U.S. Application Data

(63) Continuation-in-part of application No. 17/078,972, filed on Oct. 23, 2020, now Pat. No. 11,293,461, which is a continuation-in-part of application No. 16/663,967, filed on Oct. 25, 2019, now Pat. No. 11,118,611.

(51) Int. Cl.

| | |
|---|---|
| ***F15B 13/08*** | (2006.01) |
| ***F15B 15/26*** | (2006.01) |
| ***F04B 1/053*** | (2020.01) |
| *F15B 13/00* | (2006.01) |
| *F04B 53/22* | (2006.01) |

(52) U.S. Cl.

CPC ..... *F15B 13/0878* (2013.01); *F04B 1/053* (2013.01); *F15B 15/26* (2013.01); *F04B 53/22* (2013.01); *F15B 2013/002* (2013.01); *F15B 2015/268* (2013.01); *F15B 2211/72* (2013.01)

(58) Field of Classification Search

CPC ..... F15B 13/0875; F15B 2013/002; F15B 2015/268; F04B 1/122; F04B 1/143; F04B 1/0452; F04B 1/053; F04B 53/22; F04B 49/03; F04B 49/225

See application file for complete search history.

(56) References Cited

U.S. PATENT DOCUMENTS 4,997,344 A * 3/1991 Nelson ..... F04B 1/0408 417/273
5,655,891 A 8/1997 Deal et al.
8,307,752 B2 11/2012 Ryyppo

* cited by examiner

*Primary Examiner* — Thomas E Lazo
*Assistant Examiner* — Daniel S Collins

(57) ABSTRACT

A modular hydraulic device comprising: a housing having a receptacle having a first open end, a second end and a first port, the first port for facilitating an ingress and an egress of hydraulic fluid with respect to the housing; a sleeve configured to be received in the first open end and abut the second end; and an end cap for closing the first open end once the sleeve is inserted in the receptacle; the sleeve having: a body having a fourth lan (L4) positioned in the body for aligning with first port; a main cylinder for holding a main piston for reciprocation about a reciprocation axis; and a first bore portion fluidly coupled to the first lan, the first bore portion for receiving the ingress of the hydraulic fluid and for outputting the egress of the hydraulic fluid; wherein once assembled the main piston is coupled to a cam for facilitating said reciprocation.

22 Claims, 4 Drawing Sheets

MODULAR HYDRAULIC DEVICE

CROSS-REFERENCE TO RELATED APPLICATION

This application is continuation-in-part of U.S. patent application Ser. No. 17/078,972, filed Oct. 23, 2020 which is a continuation-in-part of U.S. patent application Ser. No. 16/663,967, filed Oct. 25, 2019, the entirety of which is herein incorporated by reference.

FIELD

The present disclosure relates to hydraulic devices.

BACKGROUND

Hydraulic pumps and motors are used predominantly in industry when mechanical actuation is desired to convert hydraulic pressure and flow into torque and angular (rotation). Examples of hydraulic application can be in braking systems, propulsion systems (e.g. automotive, drilling) as well as in electrical energy generation systems (e.g. windmills). Other common uses of hydraulic devices as a direct drive system can be in drilling rigs, winches and crane drives, wheel motors for vehicles, cranes, and excavators, conveyor and feeder drives, mixer and agitator drives, roll mills, drum drives for digesters, kilns, trench cutters, high-powered lawn trimmers, and plastic injection machines. Further, hydraulic pumps, motors, can be combined into hydraulic drive systems, for example one or more hydraulic pumps coupled to one or more hydraulic motors constituting a hydraulic transmission.

Due to currently available configurations, there exists disadvantages with hydraulic devices when operated in systems exhibiting dynamic variation fluid flow requirements. For example, the torque requirements of a load in a hydraulic system can dynamically change, such that the hydraulic device must instantaneously react to the changing flow conditions dictated by the dynamic change in the torque.

In terms of current axial and radial piston pump configurations, there exists mechanical complications in the design and use of variable angle rotating drive plates (i.e. wobble plate), in order to dynamically change the fluid flow in response to the changing torque conditions. As such, current axial piston pump designs tend to have higher than desired maintenance costs and issues, are considered operationally inefficient as compared to other reciprocating piston pump designs, and more importantly, current axial piston pumps and motors produce vibration/noise (e.g. Fluidborne noise and Structuralborne Noise). Considered by the industry as the two primary, potentially unsolvable and unwanted problems.

Further disadvantages to current hydraulic devices include unnecessary down time with component failures occur. In particular, damage to one piston and/or cylinder of a multi-piston/cylinder arrangement of the hydraulic device can result in significant downtime of the entire unit (i.e. all of the multi—piston/cylinder arrangement), due to necessary repairs to the damaged unit before the hydraulic unit can resume operation.

SUMMARY

Plug and play ability for individual piston/cylinders of a multi-piston/cylinder arrangement of a hydraulic device is not available in todays marketplace.

It is an object of the present invention to provide a hydraulic device to obviate or mitigate at least some of the above presented disadvantages.

A first aspect provided is modular hydraulic device comprising: a housing having a receptacle having a first open end, a second end and a first port, the first port for facilitating an ingress and an egress of hydraulic fluid with respect to the housing; a sleeve configured to be received in the first open end and abut the second end; and an end cap for closing the first open end once the sleeve is inserted in the receptacle; the sleeve having: a body having a fourth lan (L4) positioned in the body for aligning with first port; a main cylinder for holding a main piston for reciprocation about a reciprocation axis; and a first bore portion fluidly coupled to the first lan, the first bore portion for receiving the ingress of the hydraulic fluid and for outputting the egress of the hydraulic fluid; wherein once assembled the main piston is coupled to a cam for facilitating said reciprocation.

A further aspect provided is a method of assembling a modular hydraulic device by: installing a main piston in a main cylinder of a sleeve as a sleeve assembly; inserting the sleeve assembly into a receptacle of a housing of the modular hydraulic device; aligning a first port in the housing with a fourth lan of a body of the sleeve, the fourth lan fluidly coupled to the main cylinder; and installing an end cap on the housing in order to secure the sleeve assembly in the receptacle; wherein once assembled, an ingress and egress of hydraulic fluid with respect to the main cylinder is done in conjunction with the reciprocation of the main piston along a reciprocation axis as the hydraulic device operates.

DESCRIPTION OF FIGURES

The foregoing and other aspects will now be described by way of example only with reference to the attached drawings, in which.

DESCRIPTION OF THE PREFERRED EMBODIMENTS

Figure 1:
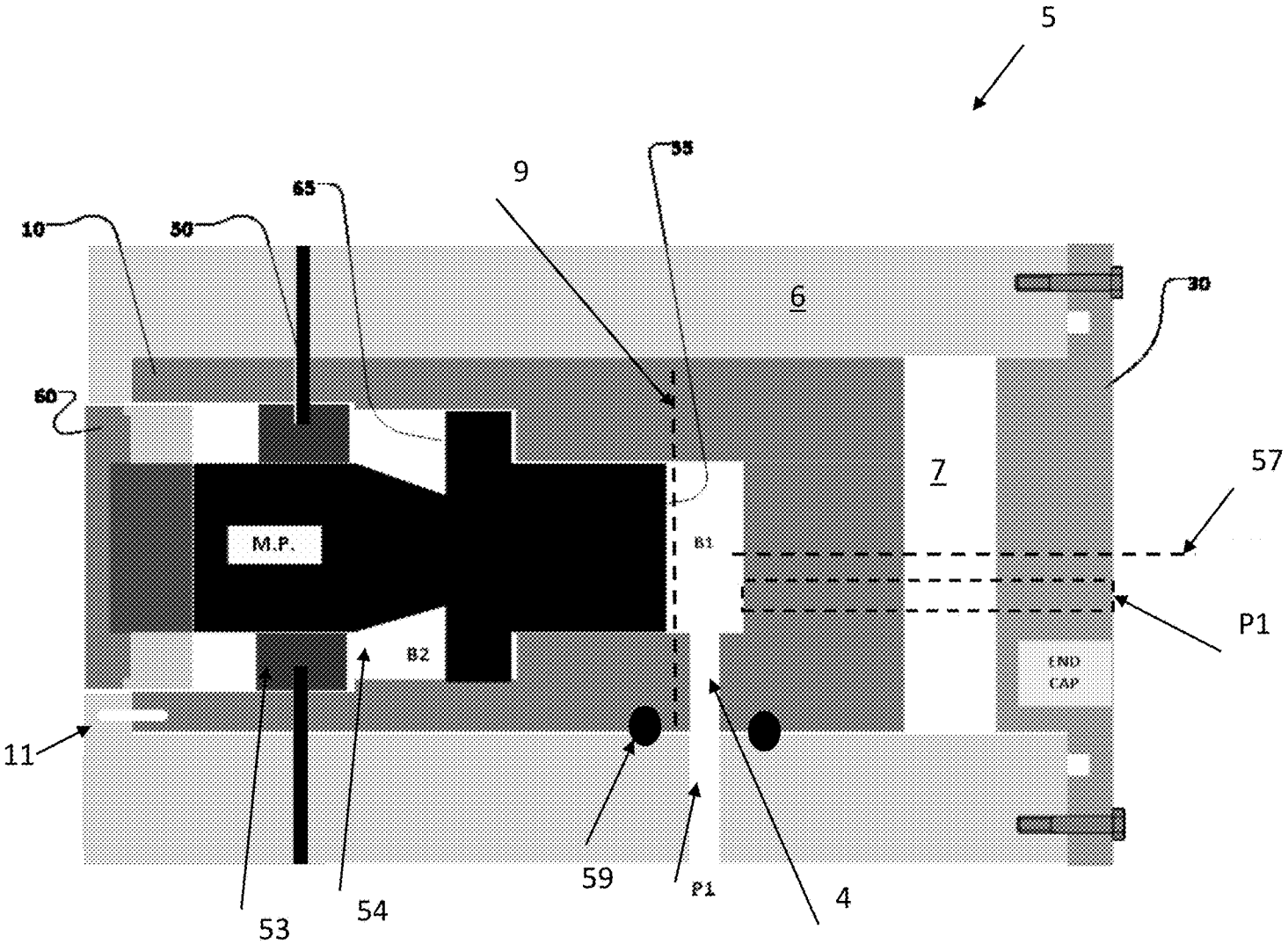
FIG. 1 refers to a schematic for a first embodiment of a hydraulic device.

Referring to FIG. 1, shown is a modular hydraulic device 5 having a housing 6 with a receptacle 3. A main piston 55 is positioned in a sleeve 10, which is inserted into and installed in the receptacle 3 (having an open first end 1) of the housing 6. The housing 6 has a shoulder 11 (of a second end 2 of the receptacle 3) for holding the sleeve 10 at one end of the housing 6, and also has an end cap 30 for holding the sleeve 10 at the other end of the housing 6. An optional spacer 7 can be used to accommodate for sleeves 10 of different lengths, such that the spacer 7 is positioned between the sleeve 10 and the end cap 30, in the event that the sleeve 10 does not contact the end cap 30 directly. As further described below, the spacer 7 can be configured as a second sleeve 15 (e.g. making the sleeve 10 an outer sleeve 10 and the second sleeve 15 an inner sleeve 15) for holding a trigger valve 75 (see FIG. 2) as further described below. For example, any of the sleeves 10 in the FIGS. 1-4 can be provided into two mating portions along line 9 (in ghosted view—see FIG. 1), such that appropriate machining of the first bore portion B1 can be facilitated. In the case of two sleeve portions 10, appropriate seals 59 could be provided between the sleeve 10 and the housing 6 in order to inhibit undesirable fluid leakage from the first bore portion B1.

It is recognised that the housing 6 can have a (e.g. lateral) port P1 for facilitating the input and ejection of hydraulic fluid into and out of a main cylinder 54, such that reciprocation (along reciprocation axis 57) of the main piston 55 in the main cylinder 54 facilitates the ingress and egress of the hydraulic fluid into a first portion/bore B1 of the main cylinder 54. The port P1 can also be positioned along the reciprocation axis 57, shown in ghosted view, for example for any of the embodiments shown in FIGS. 1-4. In the case of the lateral port P1, the housing 6 also has a lan L4 (recognizing that lan can also be referred to as passageway or channel) aligned with the lateral port P1, when the sleeve 10 is installed in the housing 6. As such, once aligned, the lan L4 and the lateral port P1 provide a conduit for ingress/egress of hydraulic fluid with respect to the first portion B1 of the main cylinder 54. As such, it is important that the lan L4 and port P1 are aligned when the sleeve 10 is installed in the housing 6, such that the first portion B1 is fluidly connected to the port P1. Seals 59 can be installed between the housing 6 and the sleeve 10 on either side of the interface between the port P1 and the lan L4, in order to inhibit leakage of the hydraulic fluid between the housing 6 and the sleeve 10 and thus into the receptacle 3. It is also recognised, not shown, that the port P1 can be configured as two separate ports with corresponding separate lans (in the housing 6), such that one of the ports (with appropriate check valve) would be used for the ingress of hydraulic fluid and the other of the ports (with appropriate check valve) would be used for the egress of hydraulic fluid with respect to the main cylinder 54. It is recognised that in the lateral configuration, the port P1 is oriented laterally (e.g. orthogonally) to the reciprocation axis 57. The main cylinder 54 also contains a second portion/bore B2, which can be used to facilitate locking of the main piston 55, as further described below in reference to FIGS. 2 and 3.

It is also recognised that the housing 6 can contain a plurality of the receptacles 3, the sleeves 10 and therefore a corresponding plurality of main piston 55 and main cylinder 54 arrangements, as desired. In this case, each of the sleeves would have a respective lan L4 for mating with a corresponding port P1 in the housing 6. Further, each respective bore portion B1 of each main piston 55 and main cylinder 54 arrangement would also be fluidly coupled to a common port P1 (i.e. the main input/output port of the hydraulic device 5).

Also shown is a cam 60 positioned adjacent to the main piston 55 opposite to the first portion B1. In the case of a pump version of the hydraulic device 5, operation of the cam 60 would be used to reciprocate the main piston 55 along the axis 57 and thus facilitate the ingress and egress of the hydraulic fluid with respect to the first portion B1 and the lateral port P1. In the pump case, a prime mover (not shown—e.g. a motor) would be used to drive the cam 60. In the case of a motor version of the hydraulic device 5, reciprocation of the main piston 55 along the axis 57 due to the ingress and egress of the hydraulic fluid (with respect to the first portion B1 and the lateral port P1) would be used to operate the cam 60. In the motor case, a prime load (not shown—e.g. a wheel) would be driven by the cam 60.

The hydraulic device 5 can also have one or more locking elements 50 (e.g. pin) for maintaining the position of the sleeve 10 within the housing 6, once installed. Also, there could be a support portion 53 (for example as part of the lockdown seal unit 45) for laterally supporting the main piston 55 during reciprocation in the main cylinder 54. The support portion 53 could also be used for forming a second portion B2 of the main cylinder 54, used as a lockdown bore (see FIG. 2) for pushing a lockdown surface 65 of the main piston 55 towards the first portion B1. The support portion 53 can be positioned with its own locking element 50 separate from the locking element 50 used to lock the sleeve 10 with respect to the housing 6, as desired.

In general, the hydraulic device 5 can be assembled by: 1) installing the main piston 55 in the sleeve 10; 2) insert the assembled sleeve 10 and piston 55 into the receptacle 3 of the housing 6, making sure that the port P1 and the lan L4 are aligned; 3) insert the locking element 50, in order to facilitate maintaining of the alignment of the lan L4 and the port P1; 4) install the cam 60 (e.g. as a roller bearing adjacent to the piston 55); and 5) install the end cap 30 (and optional spacer 7). Further, the port P1 can be connected to a hydraulic fluid reservoir (e.g. tank not shown). As well, the cam 60 can be connected to a prime mover/load (also not shown). It is recognised that the above assembly would be done for each main piston 55 of a multi-piston configuration of the hydraulic device 5. Once assembled, the ingress and egress of hydraulic fluid with respect to the first portion B1 of the main cylinder 54 is done in conjunction with the reciprocation of the main piston 55 within along the reciprocation axis 57, as the hydraulic device 5 operates.

In any event, it is recognised that an advantage of the hydraulic device 5 is that differently sized/configured main piston(s) 55 (and corresponding main cylinder(s) 54) can be provided using respective different sleeves 10, such that the different sleeves 10 would all be compatible with the location of the port(s) P1 and size (e.g. diameter) of the receptacle(s) 3 of the main housing 6. Plug and play ability for individual piston(s) 55/cylinder(s) 54 of the hydraulic device 5 is facilitated by the modular design of FIGS. 1-4. As such, the main housing 6 can remain installed in its location, while the sleeve(s) 10 and their respective main piston(s) 55 can be installed/removed from the housing as desired (e.g. for repair/maintenance, for reconfiguration of the hydraulic device 5 using differently configured main piston 55/cylinder 54 arrangements, etc.). It is also recognised that in the case of a multi-sleeve 10 configuration of the main housing 6, one or more of the receptacles 3 can be plugged by a dummy sleeve (e.g. without a main piston—not shown), such that the hydraulic device 5 could be assembled having fewer number of main piston 55/cylinder 54 arrangements than the number of receptacles 3 available in the housing 6. In this case, the multi receptacle 3 housing 6 can accommodate various different number configurations of main piston 55/cylinder 54 arrangements.

For example, the dummy sleeve can be referred to as a profile plug, such that the profile plug has a plurality of seals 59 (e.g. o rings) with channel blocking surfaces (positioned between adjacent seals 59) in order to block each of the existing ports P1, P2, P3, P8, P4, DRA, IN, P5, P6 in the housing 6 of the hydraulic device 5 (see FIGS. 1-4). As such, use of the profile plug as described can be advantageous if one of the main pistons 55, main cylinders 54 (and/or trigger valves 73 and/or override mechanism 83 is/are found to be faulty and suitable replacement(s) is/are not immediately available. In this case, the sleeve 10 of the corresponding defective component (e.g. piston 55/cylinder 54) can be removed, the profile plug inserted, the end cap 30 re-installed and the hydraulic device 5 can therefore continue to operate until a replacement component is available.

Figure 2:
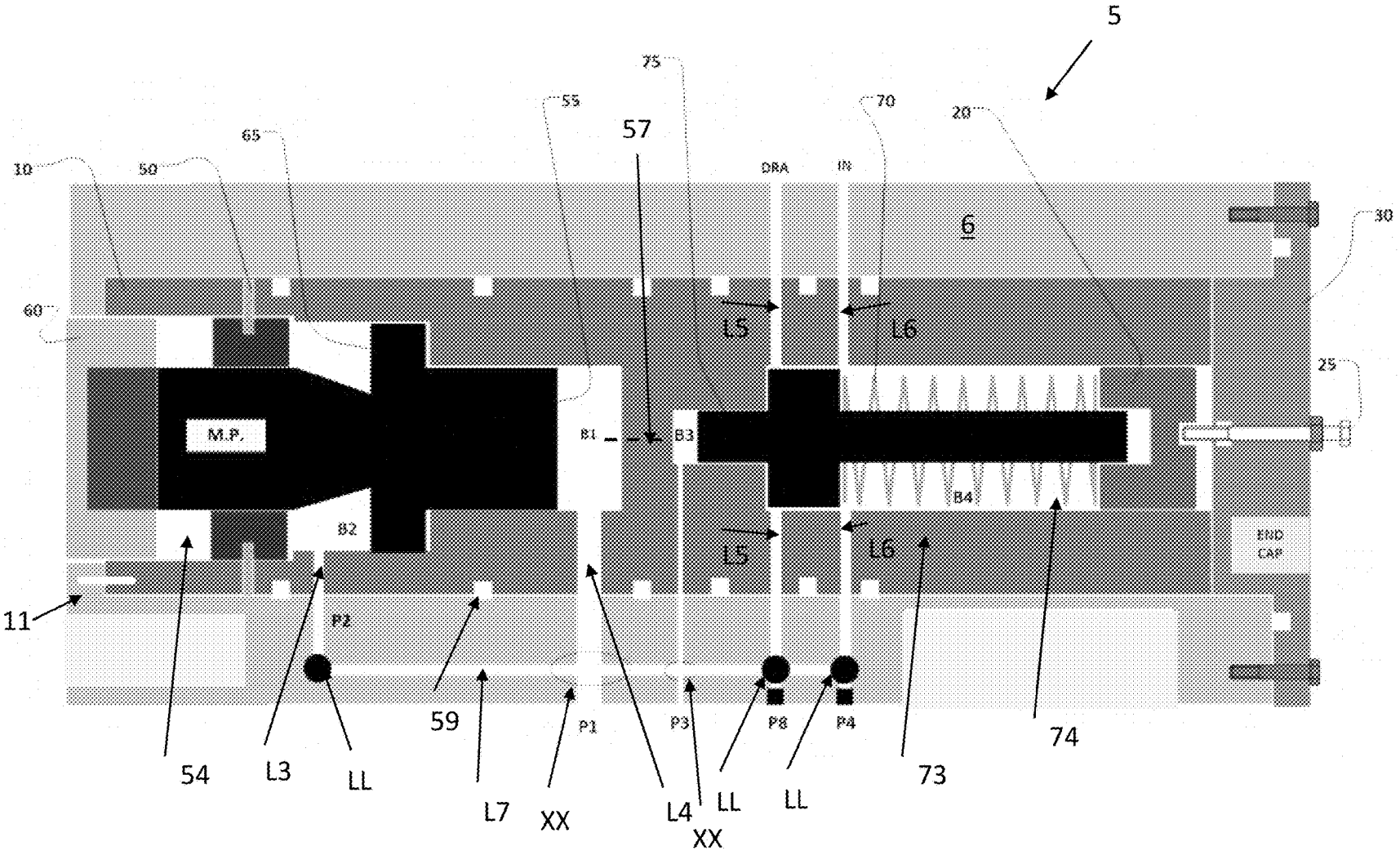
FIG. 2 is a second embodiment of the hydraulic device of FIG. 1 including a trigger device.

Referring to FIG. 2, shown is a further embodiment of the hydraulic device 5. The hydraulic device 5 has a trigger piston 75 used to lock (e.g. inhibit reciprocation) or unlock (e.g. facilitate reciprocation) of the main piston 55, as further described below. One example operation of the hydraulic device 5 of FIG. 2 is as a motor. The hydraulic device 5 has the trigger piston 75 also installed in the sleeve 10, along the reciprocation axis 57 (recognizing that the trigger valve 75 does not have to be centered on the reciprocation axis 57). The trigger piston 75 has a trigger cylinder 74, such that the trigger piston 75 can reciprocate there within. The position of the trigger piston 75 within the trigger cylinder 74 depends upon an interaction between a resilient element 70 (e.g. spring) and fluid pressure present in bore portion B3, as further described below. The combination of the trigger piston 75 and the trigger cylinder 74 can be referred to as a trigger valve 73. The trigger valve 73 is fluidly coupled to the second bore portion B2 of the main cylinder 54, the first bore portion B1 positioned on one side of the main piston 55 and the second bore portion B2 positioned on a second side of the main piston 55, the first side opposite to the second side.

It is recognised that the fluid pressure in bore portion B3 is preferably provided as a pilot pressure signal representative of the fluid pressure associated with port P1. In other words, the fluid pressure in bore portion B3 is an indirect measure of the pressure associated the port P1 (e.g. measured in a hydraulic connection line—not shown—installed between the hydraulic device 5 and a load—not shown). In any event, it is recognised that preferably the pilot signal is an indirect measure of the representative pressure in the first bore portion B1, recognizing that using a direct measure of the pressure in the first bore portion B1 as a pressure signal for the bore portion B3 would be undesirable due to inherent fluctuations in the pressure in first bore portion B1 (as the main piston 55 reciprocates).

The trigger cylinder 70 of the sleeve 10 has the bore portion B3 (fluidly coupled to the port P1) positioned in front of the trigger piston 75 and a bore portion B4 for containing the resilient element 70. An optional element spacer 20 with an adjustment member (e.g. screw) 25 can be used to adjust a strength of the resilient element 70. It is also recognised that resilient element 70 can be a compressible medium (e.g. air) or other resilient element, as desired.

Referring again to FIG. 2, the housing has a port P3 fluidly coupled to bore portion B3, such that the fluid pressure of port P1 can be sensed by the trigger piston 75 of the trigger valve 73. In this manner, when the fluid pressure during operation of the hydraulic device 5 rises (e.g. as experienced by port P1), the pilot signal fluid pressure in bore portion B3 would also rise correspondingly. When the fluid pressure pilot signal in bore portion B3 rises to a pressure greater than the strength of the resilient element 70, the trigger piston 75 would shift in the trigger cylinder 74 against the resilient element 70 and away from the bore portion B3. Alternatively, when the fluid pressure pilot signal in bore portion B3 is at a pressure less than the strength of the resilient element 70, the trigger piston 75 would shift in the trigger cylinder 74 away from the resilient element 70 and towards the bore portion B3. In this manner, the position of the trigger piston 75 within the trigger cylinder 74 is dependent upon the pressure of the hydraulic fluid within the bore portion B3 (i.e. as sensed at the face of the trigger piston 75 exposed to the bore portion B3).

Figure 3:
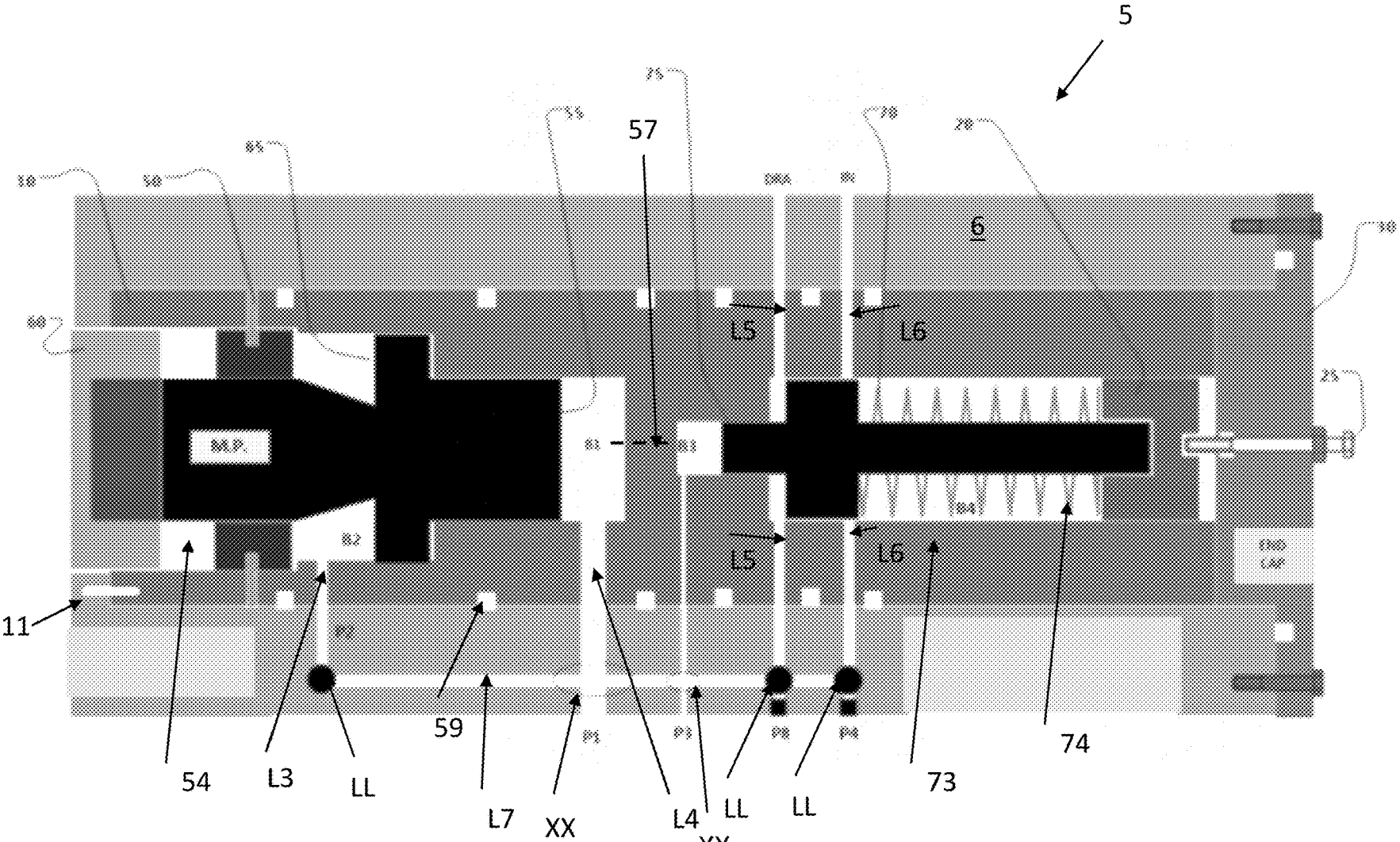
FIG. 3 is a further view of the hydraulic device of FIG. 2.
Figure 4:
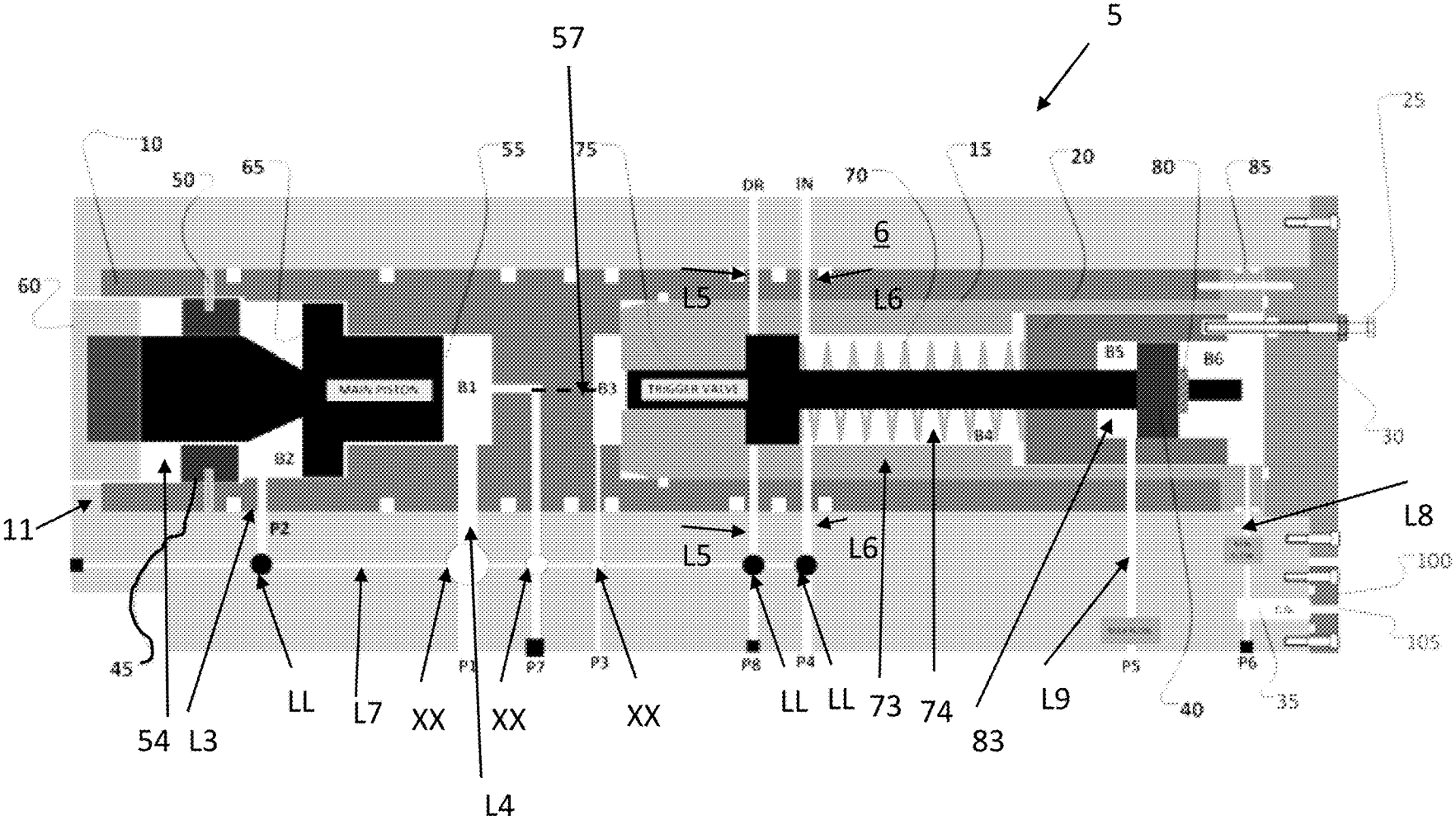
FIG. 4 is a further embodiment of the hydraulic device of FIG. 1 with a trigger device.

In FIGS. 2,3,4, it is recognised that the bore portion B3 (and optionally the resilient element 70) could be replaced/substituted with a solenoid valve (e.g. pressure transducer—not shown), such that the pressure pilot signal of port P3 could be used to operate the respective solenoid valve and thus shift the trigger piston 75 accordingly. As such, changing a state of the solenoid valve (due to the pilot pressure signal breaching a predefined pressure threshold) would be used to shift the trigger piston 75 within the trigger cylinder 74, in order to respectively open/close the lans L5, L6 in order facilitate or inhibit unlocking of the main piston 55.

Referring again to FIG. 2, the housing has a port P2 of the main housing fluidly coupled to the bore portion B2 of the main cylinder 54 by a lan L3 of the sleeve 10. As such, it is recognised that the lan L3 and the port P2 must be aligned, when the sleeve 10 is installed in the receptacle 3. Further, the sleeve 10 also contains corresponding lans L6 for coupling a hydraulic fluid source/supply IN to the trigger cylinder 74 and lans L5 for coupling a hydraulic fluid sink/reservoir DRA to the trigger cylinder 74. The housing 6 has a corresponding port P8 for coupling the lan L5 to a lan L7 (of the housing 6), thereby fluidly coupling the trigger cylinder 74 with the port P2. Further, the housing 6 has a corresponding port P4 for coupling the lan L6 to the lan L7 (of the housing 6), thereby also fluidly coupling the trigger cylinder 74 with the port P2. As such, it is recognised that the lan L5 and the port P8 would be aligned, when the sleeve 10 is installed in the receptacle 3. As such, it is recognised that the lan L6 and the port P4 would be aligned, when the sleeve 10 is installed in the receptacle 3. As further described below, it is recognised that either the hydraulic fluid source/supply IN or the hydraulic fluid sink/reservoir DRA is fluidly coupled to the second bore portion B2, depending upon the position of the trigger piston 75 in the trigger cylinder 74. Fluid connections LL signify that lans L5, L6 and port P2 are fluidly connected to lan L7. On the contrary, symbols XX portray that port P1 and port P3 are not connected to the lan L7.

In general, the hydraulic device 5 can be assembled by: 1) installing the main piston 55 in the sleeve 10; 2) install the trigger piston 75 into the trigger cylinder 74; 3) insert the biasing element 70 and the optional spacer 20; 4) insert the assembled sleeve 10 and pistons 55,75 into the receptacle 3 of the housing 6, making sure that the port P1 and the lan L4 are aligned, the port P2 and the lan L3 are aligned, the port P8 and the lan L5 are aligned, the port P4 and the lan L6 are aligned, the port DRA and the lan L5 are aligned, and the port IN and the lan L6 are aligned; 5) insert the locking element 50, in order to facilitate maintaining of the alignment of the lans L3, L4, L5, L6 and the ports P2, P1, P8, P4, DRA, IN; 6) install the cam 60 (e.g. as a roller bearing adjacent to the piston 55); and 7) install the end cap 30 (and optional adjustment using the adjustment member 25). Further, the port P1 can be connected to a hydraulic fluid reservoir (e.g. tank not shown), which can have a charge pump (not shown) therein for facilitating the supply of the hydraulic fluid from the reservoir to the port P1. As well, the cam 60 can be connected to a prime mover/load (also not shown).

It is recognised that the above assembly would be done for each main piston 55/trigger valve 73 arrangement of a multi-piston configuration of the hydraulic device 5. Once assembled, the ingress and egress of hydraulic fluid with respect to the first portion B1 of the main cylinder 54 is done in conjunction with the reciprocation of any of the unlocked main piston(s) 55 along the reciprocation axes 57, as the hydraulic device 5 operates. It is recognised that each (e.g. a one to one basis) of the main pistons 55 (if so configured) would have a corresponding trigger valve 73, such that each trigger valve 73 would be responsible for locking/unlocking of its respective main piston 55. In this manner, the various trigger valves 73 could each have differing strengths of their resilient element 70 (with respect to one another). In this way, operation of the multiple trigger valves 73 would be serial, such that as the pressure rises in port P3 (all of the ports P3 for each of the trigger valves 73 would be in fluid communication with each other/the port P1), triggered main pistons 55 would be placed in their unlocked state one after another. It is this process of serial placement of main pistons 55 in their locked/unlocked states that provides for a variable displacement operation of the hydraulic device 5, in response to the pressure pilot signal as discussed. It is also recognized that the stroke length of the main piston 55 (i.e. the distance of any reciprocation from top dead center to bottom dead center for unlocked main pistons 55 remains constant during the variable displacement operation of the hydraulic device 5).

For example, for a three main piston 55/trigger valve 73 arrangement, a setting of 200 psi, 300 psi and 400 psi could be set respectively for each of the resilient elements 70. As such, for fluid pressures in the bore portion B3 under 200 psi, the three main pistons 55 would all be locked and thus inhibited from reciprocating. Then when the fluid pressure rises to 200 psi, the first trigger valve 73 would be triggered and the first main piston 55 would be placed in the unlocked state for reciprocation while the remaining two main pistons 55 would remain in the locked state and thus inhibited from reciprocating. Then, when the fluid pressure rises to 300 psi, the second trigger valve 73 would be triggered and the second main piston 55 would be placed in the unlocked state, while the first main piston 55 remains in the unlocked state and the third main piston 55 remains in the locked state. Only when the pressure reaches 400 psi would the final third main piston 55 also be switched to the unlocked state to join the other two main pistons 55 in reciprocation, thereby having all three triggered main pistons 55 contributing to the fluid output of the hydraulic device 5 (via port P1 when operating as a pump) or consuming the fluid input to the port P1 when operating as a motor.

In any event, it is recognised that an advantage of the hydraulic device 5 of FIG. 2 is that differently (or similarly) sized/configured main piston(s) 55 (and corresponding trigger valves 73) can be provided using respective different sleeves 10, such that the different sleeves 10 would all be compatible with the location of the port(s) P1, P2, P8, P4 and size (e.g. diameter) of the receptacle(s) 3 of the main housing 6. As such, the main housing 6 can remain installed in its location, while the sleeve(s) 10 and their respective main piston(s) 55/trigger valves 73 can be installed/removed from the housing as desired (e.g. for repair/maintenance, for reconfiguration of the hydraulic device 5 using differently configured main piston 55/cylinder 54 arrangements, with or without trigger valves 73—see FIG. 1, etc.). It is also recognised that in the case of a multi-sleeve 10 configuration of the main housing 6, one or more of the receptacles 3 can be plugged by a dummy sleeve (e.g. without a main piston—not shown), such that the hydraulic device 5 could be assembled having fewer number of main piston 55/cylinder 54 arrangements than the number of receptacles 3 available in the housing 6. In this case, the multi receptacle 3 housing 6 can accommodate various different number configurations of main piston 55/cylinder 54 arrangements and/or presence or absence of their corresponding trigger valve(s) 73—see FIGS. 1,2.

Referring to FIG. 2, shown is the operational example by which the fluid pressure in bore portion B3 is at a pressure less than the strength of the resilient element 70, and therefore the trigger piston 75 is shifted in the trigger cylinder 74 away from the resilient element 70 and towards the bore portion B3. In this position, the trigger piston 75 blocks fluid communication between the fluid sink/reservoir DRA and the bore portion B2 (lans L5 are blocked from communicating with port P8), while facilitates fluid communication between the hydraulic fluid source/supply IN and the bore portion B2 (lans L6 are open and thus are communicating with port P4). As such, hydraulic fluid is allowed to fill bore portion B2 and thus shift the main piston 55 away from the cam 60 and towards the bore portion B1. In this state, ingress/egress of fluid with respect to the bore portion B1 is inhibited and the state of the main piston 55 is referred to as a locked or lockdown state (i.e. reciprocation along the reciprocation axis 57 due to any influence of the cam 60 and/or ingress/egress of fluid with respect to the bore portion B1 is inhibited).

For example, in this manner, hydraulic fluid from charge pump (e.g. as input for port P1) can still enter first bore portion B1 but cannot exit as the head pressure of the hydraulic fluid in the outlet gallery is assumed to be higher than injection pressure. As such, the charged hydraulic fluid input is not strong enough to shift the main piston 55 against the cam 60 due to the larger surface area 65 of the main piston 55 inside the second bore portion B2, as compared to the relative smaller surface area of the main piston 55 in the first bore portion B1. In this manner, operation of the trigger piston 55 (e.g. under the influence of the resilient element 70) has caused the main piston 55 to be placed in the lockdown state. Therefore, while in this lockdown state, the main piston 55 does not contribute to movement of hydraulic fluid into/out of the port P1, recognizing that any other main pistons 55 (in their open state) would contribute to the movement of hydraulic fluid into/out of the port P1 for a multi main piston 55/cylinder 54 arrangement of the hydraulic device 5.

Referring to FIG. 3, shown is the operational example by which the fluid pressure in bore portion B3 is at a pressure greater than the strength of the resilient element 70, and therefore the trigger piston 75 is shifted in the trigger cylinder 74 towards the resilient element 70 and away from the bore portion B3. In this position, the trigger piston 75 facilitates fluid communication between the fluid sink/reservoir DRA and the bore portion B2 (lans L5 are open for communicating with port P8), while inhibits fluid communication between the hydraulic fluid source/supply IN and the bore portion B2 (lans L6 are blocked and thus are inhibited from communicating with port P4). As such, hydraulic fluid is allowed to drain from bore portion B2 and thus shift the main piston 55 towards the cam 60 and away from the bore portion B1. In this state, ingress/egress of fluid with respect to the bore portion B1 is facilitated and the state of the main piston 55 is referred to as an open or unlocked state (i.e. reciprocation along the reciprocation axis 57 due to any influence of the cam 60 and/or ingress/egress of fluid with respect to the bore portion B1 is facilitated). In this manner, operation of the trigger piston 55 (e.g. under the influence of the fluid pressure in the bore portion B3 against the resilient element 70) has caused the main piston 55 to be placed in the open state. Therefore, while in this open state, the main piston 55 reciprocates and thus contributes to movement of hydraulic fluid into/out of the port P1, recognizing that any other main pistons 55 (in their open state) would also contribute to the movement of hydraulic fluid into/out of the port P1 for a multi main piston 55/cylinder 54 arrangement of the hydraulic device 5.

Referring to FIG. 4, shown is a further embodiment of the hydraulic device 5 of FIG. 1, for example a hydraulic pump. Provided is a second sleeve 15 positioned in the sleeve 10. The hydraulic device 5 can have further pin elements 85 (e.g. anti rotation locking pin) for maintaining the position of the inner or second sleeve 15 with respect to the first sleeve 10. The hydraulic device 5 can also have a lockdown seal unit 45 for inhibiting fluid leakage from the bore portion B2 into the main cylinder 54 adjacent to the cam 60. Further, a port P7 can be used to connect to the bore portion B1 for sampling of the fluid pressure within the bore portion B1 of the individual bore.

The trigger valve 73 can optionally have an override mechanism 83 having override piston 40 located in an override bore 80 (e.g. situated within the spacer 20). The override piston 40 is coupled to the trigger piston 75, such that movement of the override piston 40 in the override bore 80 is synchronized (i.e. moves concurrently) with movement of the trigger piston 75 in the trigger cylinder 74. The override bore 80 has a first portion 85 and a second portion 86. The first portion 85 is fluidly coupled to port P5 which is connected to a fluid sink/source not shown. The port P5 is fluidly connected to the first portion 85 via a lan L9, while a lan L8 fluidly couples the second portion 86 with a common gallery 35 (e.g. an access port P6 can be used in order to form the lan L8 within the housing 6). The common gallery 35 can be formed in the housing via an endcap 100 having an inlet/outlet port 100 for hydraulic fluid from a fluid source/sink (not shown). It is recognised that the override mechanism 83 can also be installed/configured in the hydraulic device 5 of FIGS. 2, 3. Further, the ports P5, P6, common gallery 35, and lans L8, L9 can also be substituted for a solenoid (not shown) for each trigger valve 73. These solenoids can be activated by an operator of the hydraulic device 5 in order to shift the trigger piston 75 upon demand (in order to lock/unlock all or selected main pistons 55 as described).

In general, the hydraulic device 5 of FIG. 4 can be assembled by: 1) installing the main piston 55 in the sleeve 10; 2) install the trigger piston 75 into the trigger cylinder 74 of the second sleeve 15; 3) insert the biasing element 70 and the spacer 20 in the second sleeve 15; 4) assemble the lockdown piston 40 to the trigger piston 75; 5) insert the second sleeve 15 into the first sleeve 10, making sure that the lan L9 will be aligned with port P5 and the lan L8 will be aligned with the port P6 (i.e. also with the common gallery 35); 6) lock the sleeves 10,15 together using the locking element 85; 7) insert the assembled sleeves 10, 15 with pistons 40,55,75 into the receptacle 3 of the housing 6, making sure that the port P1 and the lan L4 are aligned, the port P2 and the lan L3 are aligned, the port P8 and the lan L5 are aligned, the port P4 and the lan L6 are aligned, the port DRA and the lan L5 are aligned, and the port IN and the lan L6 are aligned; 8) insert the locking element 50, in order to facilitate maintaining of the alignment of the lans L3,L4, L5,L6 and the ports P2,P1,P8,P4,DRA,IN; 9) install the cam 60 (e.g. as a roller bearing adjacent to the piston 55); and 10) install the end caps 30,100 (and optional adjustment using the adjustment member 25). Further, the port P1 can be connected to a hydraulic fluid reservoir (e.g. tank not shown). As well, the cam 60 can be connected to a prime mover/load (also not shown).

It is recognised that the above assembly would be done for each main piston 55/trigger valve 73 arrangement of a multi-piston configuration of the hydraulic device 5. Once assembled, the ingress and egress of hydraulic fluid with respect to the first portion B1 of the main cylinder 54 is done in conjunction with the reciprocation of any of the unlocked main piston(s) 55 along the reciprocation axes 57, as the hydraulic device 5 operates. It is recognised that each of the main pistons 55 (if so configured) would have a corresponding trigger valve 73, such that each trigger valve 73 would be responsible for locking/unlocking of its respective main piston 55. In this manner, the various trigger valves 73 could each have differing strengths of their resilient element 70 (with respect to one another). In this way, operation of the multiple trigger valves 73 would be serial, such that as the pressure rises in port P3 (all of the ports P3 for each of the trigger valves 73 would be in fluid communication with each other/the port P1), triggered main pistons 55 would be placed in their unlocked state one after another.

In any event, it is recognised that an advantage of the hydraulic device 5 of FIG. 4 is that differently sized (or same sized)/configured main piston(s) 55 (and corresponding trigger valves 73—with or without override mechanisms 83) can be provided using respective different sleeves 10,15 such that the different sleeves 10,15 would all be compatible with the location of the port(s) P1, P2, P8, P4, P5, P6 and size (e.g. diameter) of the receptacle(s) 3 of the main housing 6. As such, the main housing 6 can remain installed in its location, while the sleeve(s) 10,15 and their respective main piston(s) 55/trigger valves 73 and override piston(s) 83 can be installed/removed from the housing 6 as desired (e.g. for repair/maintenance, for reconfiguration of the hydraulic device 5 using differently configured main piston 55/cylinder 54 arrangements, with or without trigger valves 73 and/or override mechanism(s) 83—see FIGS. 1,2,3, etc.).

In operation, referring to FIG. 4, the override mechanism 83 can be such that an operator of the hydraulic device 5 can cause the trigger piston 75 to shift (by supplying the second portion 86 with fluid from the common gallery 35) towards the bore B3 and thus close off lans L5 and open lans L6 (see FIG. 2 whereby lan L5 with port P8 is closed off and lan L6 with port P4 and port IN are open). In this state, the trigger valve 75 is forced into the locked state, irregardless of the fluid pressure in the bore B3. The locked state position of the trigger piston 75 facilitates the flow of hydraulic fluid into the bore B2, as sourced from the hydraulic fluid source/supply IN via lans L3, L7, L6. It is recognised that the operator of the hydraulic device 5 would cause the input of hydraulic fluid into the second portion 86 of a sufficient pressure to overcome any resistance to movement of the trigger piston 75 towards the bore B3 (in view of the pressure of hydraulic fluid resident in the bore B3). Once the bore B2 is filled with hydraulic fluid, the main piston 55 is thus shifted towards the bore B1, hence the main piston 55 decouples from the cam 60 and thus is placed in the lockdown state. This operation of the override mechanism 83 can be referred to as a minimum flow state, in which the hydraulic device 5 operator wishes to artificially (e.g. on demand) reduce the number of working pistons 55 (i.e. placing one or more of the working pistons 55 into a lock down state irrespective of the hydraulic pressure in bore B3) and thus maximize torque in operation of the hydraulic device 5.

On the contrary, the override mechanism 83 can be such that an operator of the hydraulic device 5 can cause the trigger piston 75 to shift (by supplying the first portion 85 with fluid from the port P5) away from the bore B3 and thus close off lans L6 and open lans L5 (see FIG. 3). In this state, the trigger valve 75 is forced into the unlocked state, irregardless of the fluid pressure in the bore B3. The unlocked state position of the trigger piston 75 facilitates the flow of hydraulic fluid out of the bore B2, as drained to the hydraulic fluid sink/reservoir DR via lans L3, L7, L5. It is recognised that the operator of the hydraulic device 5 would cause the input of hydraulic fluid into the first portion 85 of a sufficient pressure to overcome any resistance to movement of the trigger piston 75 away from the bore B3 (in view of the strength of the resilient element 70 regardless of the pressure of the hydraulic fluid in the bore B3). Once the bore B2 is emptied of hydraulic fluid, the main piston 55 is thus shifted away from the bore B1, hence the main piston 55 couples with the cam 60 and thus is placed in the unlocked state (i.e. free to continue to reciprocate). This operation of the override mechanism 83 can be referred to as a maximum flow state, in which the hydraulic device 5 operator wishes to artificially (e.g. on demand) increase the number of working pistons 55 (i.e. placing one or more of the working pistons 55 into an unlocked state irrespective of the hydraulic pressure in bore B3 and thus irrespective of the possibility of low head pressure) and thus maximize speed in operation of the hydraulic device 5.

As such, the override mechanism 83 is configured for switching the trigger valve 75 between the locked state and the unlocked state irrespective of the value of the separate pressure pilot signal (in bore portion B3) associated with the trigger valve 75. As noted, the override piston 80 is coupled to the trigger piston 75, wherein operation of the override mechanism 83 conjointly moves both the trigger piston 75 and the override piston 80.

It is also recognised that the device 5 could be embodied as a pneumatic device, such that the port P1 is used for the ingress and egress of a compressible medium (e.g. air) into the bore portion B1 and the bore portion B3 (when present for the optional trigger valve 73) is for sensing a pilot pressure of the compressible medium.

The invention claimed is:

1. A modular hydraulic device comprising:

a housing having a receptacle having a first open end, a second end and a first port, the first port for facilitating an ingress and an egress of hydraulic fluid with respect to the housing;

a sleeve configured to be received in the first open end and abut the second end; and an end cap for closing the first open end once the sleeve is inserted in the receptacle;

the sleeve having:

a body having a fourth Ian positioned in the body for aligning with the first port;

a main cylinder for holding a main piston for reciprocation about a reciprocation axis; and a first bore portion fluidly coupled to the fourth Ian, the first bore portion for receiving the ingress of the hydraulic fluid and for outputting the egress of the hydraulic fluid; and a trigger valve positioned in the body of the sleeve, the trigger valve is operatively coupled with a second bore portion of the main cylinder;

wherein once assembled the main piston is coupled to a cam for facilitating said reciprocation and when the trigger valve is operated the main piston is transitioned between a locked state and an unlocked state.

2. The modular hydraulic device of claim 1, wherein the first port is positioned laterally to the reciprocation axis, such that the fourth Ian and the first port are aligned when the sleeve is installed in the receptacle.

3. The modular hydraulic device of claim 1, wherein the hydraulic device is a hydraulic motor.

4. The modular hydraulic device of claim 1, wherein the hydraulic device is a hydraulic pump.

5. The modular hydraulic device of claim 1, wherein the first bore portion is positioned on one side of the main piston and the second bore portion is positioned on a second side of the main piston, the first side opposite to the second side.

6. The modular hydraulic device of claim 5 further comprising a third Ian positioned in the body aligned with a second port in the housing to facilitate said trigger valve fluidly coupled to the second bore portion.

7. The modular hydraulic device of claim 5 further comprising a fifth Ian positioned in the body aligned with both an eighth port and a drain port of the housing, the fifth Ian to facilitate draining of hydraulic fluid from the second bore portion when the trigger valve is positioned in an unlocked state.

8. The modular hydraulic device of claim 5 further comprising a sixth Ian positioned in the body aligned with both a fourth port and an inlet port of the housing, the sixth Ian to facilitate filling of the second bore portion with hydraulic fluid when the trigger valve is positioned in a locked state.

9. The modular hydraulic device of claim 5, wherein trigger valve comprises a trigger piston positioned for reciprocation within a trigger cylinder of the body, such that movement within the trigger cylinder by the trigger piston operates the main piston between a locked state and an unlocked state.

10. The modular hydraulic device of claim 9, wherein said movement by the trigger piston does one of: blocking a sixth Ian and unblocking a fifth Ian or unblocking a sixth Ian and blocking a fifth Ian, in order to switch the main piston between the locked state and the unlocked state.

11. The modular hydraulic device of claim 5 further comprising a third bore portion coupled to the trigger valve for providing a pressure pilot signal, the pressure pilot signal representative of a fluid pressure associated with the first port, the third bore portion fluidly coupled to a third port of the housing in the body; wherein the third bore portion and the third port are aligned when the sleeve is inserted into the receptacle.

12. The modular hydraulic device of claim 2 further comprising one or more seals for sealing a fluid connection between the fourth Ian and the first port.

13. The modular hydraulic device of claim 5 further comprising a resilient element positioned in a trigger cylinder of the trigger valve, the resilient element for biasing a trigger piston against a pressure pilot signal.

14. The modular hydraulic device of claim 13 further comprising an adjustment mechanism for adjusting a strength of the resilient element.

15. The modular hydraulic device of claim 5 further comprising a second sleeve positioned within the first sleeve, the second sleeve for containing the trigger valve.

16. The modular hydraulic device of claim 5 further comprising an override mechanism, the override mechanism for switching the trigger valve between a locked state and an unlocked state irrespective of a value of a separate pressure pilot signal associated with the trigger valve.

17. The modular hydraulic device of claim 16 further comprising an override piston coupled to a trigger piston of the trigger valve, wherein operation of the override mechanism conjointly moves both the trigger piston and the override piston.

18. The modular hydraulic device of claim 17 further comprising a override bore having a first portion and a second portion, such that the first portion and the second portion are on opposing sides of the override piston when positioned in the override bore.

19. The modular hydraulic device of claim 17 further comprising the first portion fluidly coupled to a fifth port which is connected to a first fluid sink or source and the second portion fluidly coupled to a sixth port which is connected to a second fluid sink or source, such that selective filling or draining of first and second portions facilitates movement of the override piston.

20. The modular hydraulic device of claim 1, wherein the main piston is one of a plurality of main pistons, such that each of the plurality of main pistons is positioned in a respective sleeve of a plurality of sleeves and each sleeve of the plurality of sleeves is configured to be received in a respective receptacle of the housing.

21. A method of assembling a modular hydraulic device by:

installing a main piston in a main cylinder of a sleeve as a sleeve assembly;

inserting the sleeve assembly into a receptacle of a housing of the modular hydraulic device;

aligning a first port in the housing with a fourth Ian of a body of the sleeve, the fourth Ian fluidly coupled to the main cylinder;

installing an end cap on the housing in order to secure the sleeve assembly in the receptacle;

positioning a trigger valve in the body of the sleeve such that the trigger valve is operatively coupled with a second bore portion of the main cylinder; and operating the trigger valve to transition the main piston between a locked state and an unlocked state;

wherein once assembled, an ingress and egress of hydraulic fluid with respect to the main cylinder is done in conjunction with the reciprocation of the main piston along a reciprocation axis as the hydraulic device operates.

22. The method of claim 21, wherein the first port is positioned laterally to the reciprocation axis, such that the fourth Ian and the first port are aligned when the sleeve assembly is installed in the receptacle.

* * * * *